US006360776B1

(12) United States Patent
McCormick et al.

(10) Patent No.: US 6,360,776 B1
(45) Date of Patent: Mar. 26, 2002

(54) APPARATUS FOR PREMIXING IN A GAS TURBINE ENGINE

(75) Inventors: Keith Alan McCormick, Indianapolis; Duane A. Smith, Carmel, both of IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 09/704,290

(22) Filed: Nov. 1, 2000

(51) Int. Cl.[7] ..... F23R 3/46
(52) U.S. Cl. ..... 137/896; 60/737; 60/747
(58) Field of Search ..... 137/896, 602; 431/284; 60/737, 747

(56) References Cited

U.S. PATENT DOCUMENTS

| | | | | |
|---|---|---|---|---|
| 3,483,701 | A | | 12/1969 | Harvey et al. |
| 4,271,675 | A | | 6/1981 | Jones et al. |
| 4,455,839 | A | | 6/1984 | Wuchter |
| 4,932,861 | A | | 6/1990 | Keller et al. |
| 5,020,329 | A | | 6/1991 | Ekstedt et al. |
| 5,081,844 | A | | 1/1992 | Keller et al. |
| 5,154,059 | A | | 10/1992 | Keller |
| 5,193,995 | A | | 3/1993 | Keller et al. |
| 5,257,499 | A | | 11/1993 | Leonard |
| 5,274,993 | A | | 1/1994 | Keller |
| 5,307,634 | A | | 5/1994 | Hu |
| 5,375,995 | A | | 12/1994 | Döbbeling et al. |
| 5,402,633 | A | | 4/1995 | Hu |
| 5,461,865 | A | | 10/1995 | Snyder et al. |
| 5,511,375 | A | | 4/1996 | Joshi et al. |
| 5,592,819 | A | | 1/1997 | Ansart et al. |
| 5,611,196 | A | | 3/1997 | Wilson |
| 5,664,943 | A | | 9/1997 | Joos et al. |
| 5,675,971 | A | | 10/1997 | Angel et al. |
| 5,699,667 | A | | 12/1997 | Joos |
| 5,782,627 | A | * | 7/1998 | Döbbeling et al. ..... 431/285 X |
| 5,791,562 | A | | 8/1998 | Kramer et al. |
| 5,822,992 | A | | 10/1998 | Dean |
| 5,832,732 | A | | 11/1998 | Knöpfel et al. |
| 5,943,866 | A | | 8/1999 | Lovett et al. |
| 6,016,658 | A | | 1/2000 | Willis et al. |
| 6,019,596 | A | | 2/2000 | Knöpfel et al. |
| 6,038,863 | A | | 3/2000 | Keller et al. |

OTHER PUBLICATIONS

"Emission And Performance Of A Lean–Premixed Gas Fuel Injection System For Aeroderivative Gas Turbine Engines" 1994 Transactions of the ASME, 94–GT–234, pp. 1–7.
"Development Of An Aeroderivative Gas Turbine Dry Low Emissions Combustion System" 1993 Transactions of the ASME, 93–GT–288, pp.1–6.

* cited by examiner

*Primary Examiner*—Kevin Lee
(74) *Attorney, Agent, or Firm*—Woodard, Emhardt, Naughton, Moriarty & McNett

(57) ABSTRACT

An apparatus for mixing fuel with oxidizing agent is disclosed comprising an outer body and an inner body. The outer body has an interior surface extending between an inlet end toward an outlet end. The interior surface includes a first plurality of openings. The inner body has an exterior surface extending between the first end and the second end of the inner body. The exterior surface of the inner body includes a second plurality of openings. At least a portion of the exterior surface of the inner body is positioned within the outer body to define a mixing channel between the exterior surface of the inner body and the interior surface of the outer body. In one form the first and second plurality of openings substantially longitudinally span at least one of the outer body and the inner body. In another form the first and second plurality of openings are substantially radially oriented. In yet another form the first and second plurality of openings are offset from one another.

31 Claims, 6 Drawing Sheets

APPARATUS FOR PREMIXING IN A GAS TURBINE ENGINE

This invention was made with U.S. Government support under contract number DE-FC21-96-MC33066 awarded by the Department of Energy, and the U.S. Government may have certain rights in the invention.

BACKGROUND OF THE INVENTION

This invention relates generally to an apparatus and method for mixing fuel and an oxidizing agent, such as air. In particular, various embodiments of the present invention relate to a premixer for use in turbo-machinery.

A gas turbine engine is typical of turbo-machinery in which the concept described herein may be employed. It is well known that a gas turbine engine conventionally comprises a compressor for compressing inlet air to an increased pressure for combustion in a combustion chamber. A mixture of fuel and the increased pressure air is burned in the combustion chamber to generate a high temperature gaseous flow stream for causing rotation of turbine blades within the turbine. The turbine blades convert the energy from the high temperature gaseous flow stream into kinetic energy, that is utilized to turn an electrical generator, pump, or other mechanically driven device. Further, the high temperature gaseous flow stream may be used as a heat source to produce steam or provide energy for chemical processing.

Significant reductions in pollutant emissions from gas turbine engines are required to meet increasingly stringent regulatory requirements. Particular interest is focused on reducing nitrogen oxide ($NO_x$) emissions, while preferably maintaining carbon monoxide (CO) and unburned hydrocarbon (UHC) at current or slightly reduced levels. Several approaches exist for lowering $NO_x$ emissions, but the generally accepted best practice is to reduce the kinetic formation of $NO_x$ by lowering the temperature at which the fuel and air react in the combustor. In a conventional combustor, fuel and air react as they mix within the combustor volume, resulting in extremely high temperatures at the flame front. The lean premixed (LPM) approach reduces reaction temperature by mixing the fuel and air prior to allowing combustion reactions to proceed. If fuel and air are well premixed spatially and temporally prior to combustion, the resulting combustion reactions proceed at a uniform, low temperature which leads to reduced $NO_x$ production. Hence a device is required that can consistently provide high levels of premixing between fuel and air, and deliver these reactants to the combustor, preferably in such a way as to ensure stable combustion while preventing flashback of the flame into the premixing section and autoignition of reactants within the premixing chamber.

Thus a need remains for further contributions in the area of premixing technology. The present invention satisfies this need in a novel and nonobvious way.

SUMMARY OF THE INVENTION

In one form of the present invention there is an apparatus for mixing fuel with oxidizing agent, comprising a first member and a second member. The first member is substantially hollow and has an inner surface and an outer surface. The surfaces extend between an inlet end and an outlet end of the first member. The inner surface includes a first plurality of substantially radially oriented openings connected to a first passageway receiving a first oxidizing agent. The second member has a first end and a second end and an exterior surface extending therebetween. The exterior surface includes a second plurality of substantially radially oriented openings connected to a second passageway receiving a second oxidizing agent. At least a portion of the exterior surface of the second member is positioned within the first member so that the inner surface of the first member and the exterior surface of the second member define a mixing channel.

In another form of the present invention there is an apparatus for mixing fuel with oxidizing agent, comprising an outer body and an inner body. The outer body has an interior surface that extends between an inlet end and an outlet end. The interior surface of the outer body includes a first plurality of openings. The inner body has an exterior surface that extends between a first end and a second end. The exterior surface of the inner body includes a second plurality of openings. At least a portion of the exterior surface of the inner body is positioned within the outer body to define a mixing channel. The mixing channel being defined by the exterior surface of the inner body and the interior surface of the outer body. The first and second plurality of opening substantially longitudinally span at least one of the inner body and the outer body.

In yet another form of the present invention there is an apparatus for mixing fuel with oxidizing agent, comprising a substantially hollow first body and a second body at least partially positioned within the first body. The first body has an inner surface including a first plurality of openings. The first plurality of openings are spaced around a perimeter of the inner surface at an axial location of the inner surface. The second body has an outer surface including a second plurality of openings, the second plurality of openings are spaced around a perimeter of the outer surface of the second body. The second plurality of openings are offset from the first plurality of openings at the axial location.

In another form of the present invention there is a method of mixing a fuel and an oxidizing agent. The method comprises providing a first body having an inner surface with a first length extending between an inlet end and an outlet end, the inner surface defining a mixing volume. At least a portion of a second body having an outer surface is positioned within the mixing volume, the outer surface of the second body and the inner surface of the first body defining a mixing channel, the outer surface having a second length extending between a first end and a second end. Fuel is injected into the mixing channel at the inlet end. An oxidizing agent such as air is introduced into the mixing channel substantially radially inward from the inner surface of the first body. An oxidizing agent such as air is also introduced into the mixing channel substantially radially outward from the outer surface of the second body. In one refinement of this form of the invention the oxidizing agent introduced substantially radially inwardly is radially offset from that introduced substantially radially outwardly. In another refinement the oxidizing agents are introduced substantially along the entirety of at least one of the lengths of the respective bodies.

One object of the present invention is to provide a unique apparatus and method for mixing a fuel with an oxidizing agent.

Related objects and advantages of the present invention will be apparent from the following description.

DESCRIPTION OF THE PREFERRED EMBODIMENTS

Figure 1:
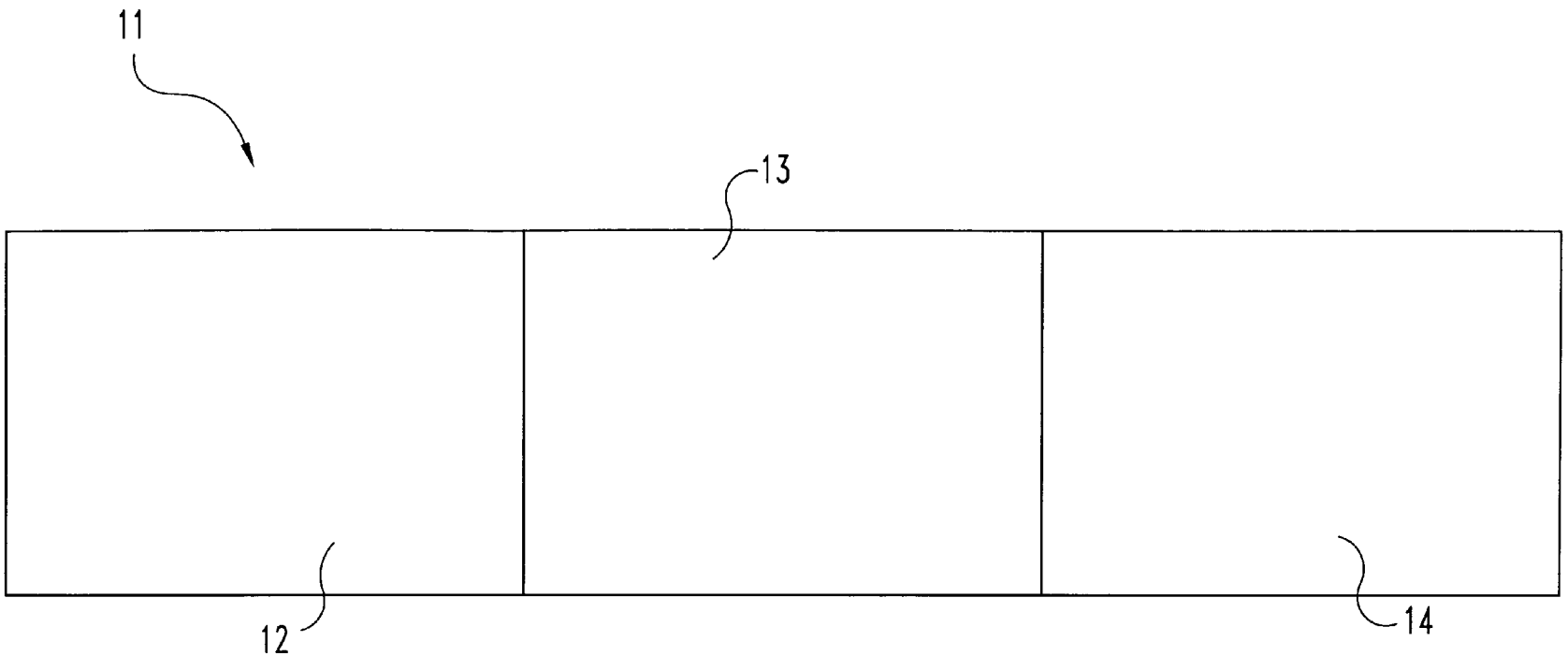
FIG. 1 is a schematic representation of the components of a generic gas turbine engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a generic representation of a gas turbine engine 11 that includes a compressor section 12, a combustor section 13, and a turbine section 14 that are integrated together. It is important to realize that there are multitudes of ways in which the gas turbine engine components can be linked together. Additional compressors and turbines could be added with intercoolers connecting between the compressors, and reheat combustion chambers could be added between the turbines. Further details related to the principles and components of a conventional gas turbine engine will not be described herein as they are believed known to one of ordinary skill in the art. It should be understood that the preferred application of the present invention is in a gas turbine engine used for an industrial application. The present invention is applicable to a wide variety of combustion systems, including but not limited to in line combustion system and silo combustion system. Examples of an in line combustion system and an off line silo combustion system are set forth in U.S. Pat. No. 6,094,916 to Puri, which is incorporated herein by reference. Historically, there has been widespread application of industrial gas turbine engines, such as pumping sets for gas and oil transmission lines, electricity generation, and naval propulsion.

Figure 2:
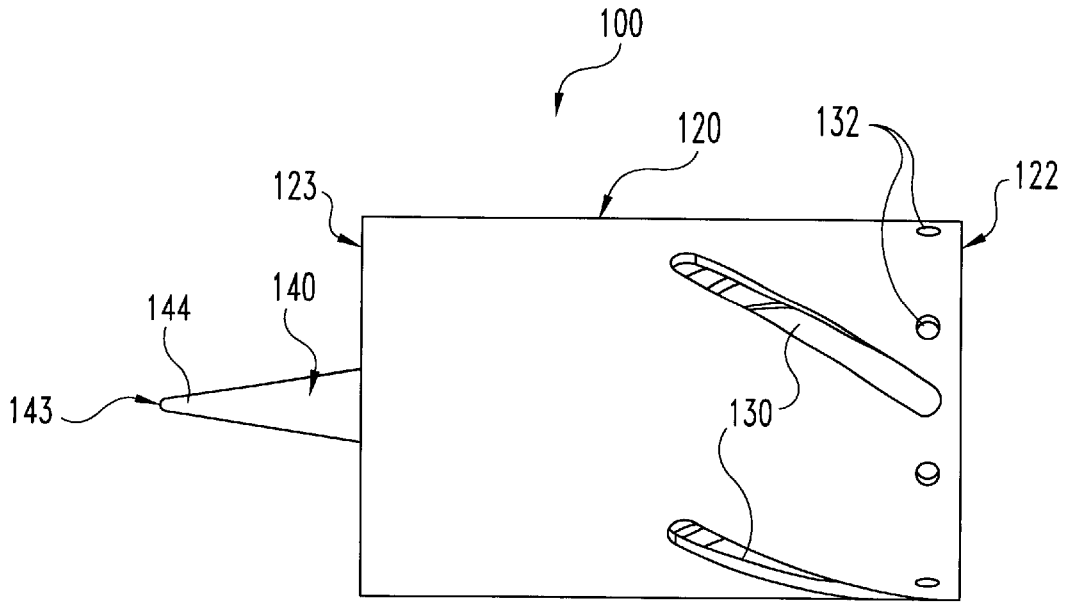
FIG. 2 is a side view of one form of the premixer of the present invention.
Figure 3:
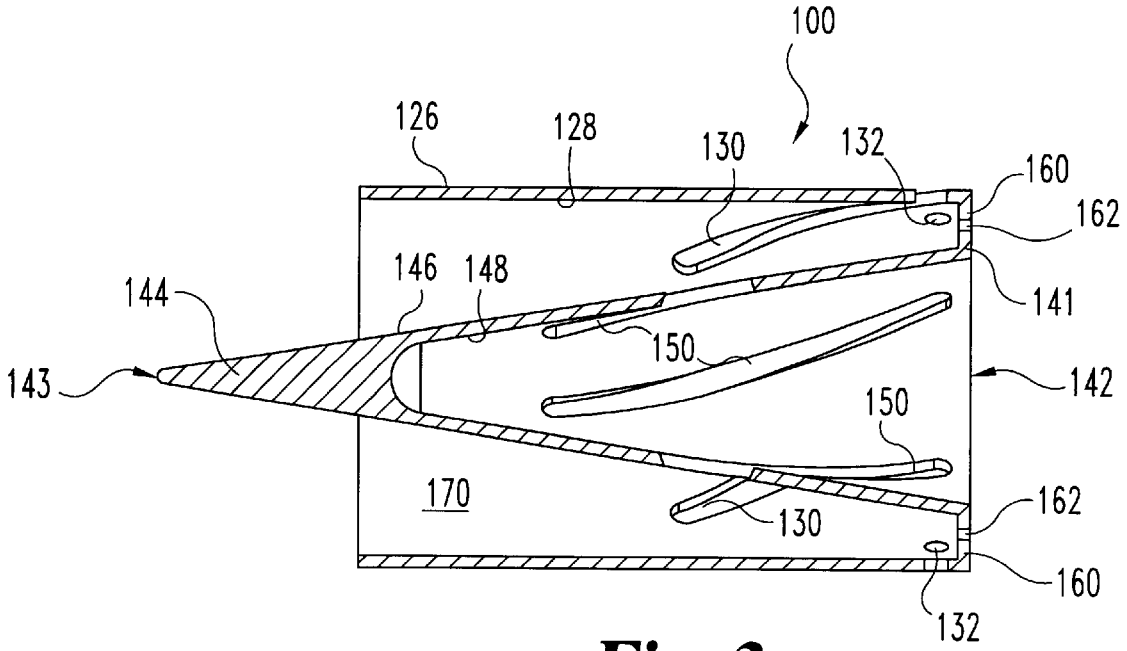
FIG. 3 is a side cross-sectional view of the premixer of FIG. 2.

With reference to FIGS. 2 and 3 there is illustrated one form of the present invention. The premixer 100 includes a first or outer body 120 and a second or inner body 140. The outer body 120 has an outer or exterior surface 126 and an inner or interior surface 128. The surfaces 126, 128 of outer body 120 extend between a head or inlet end 122 and an exhaust or outlet end 123. The outer body 120 is substantially hollow and has a first plurality of openings 130 extending between the interior surface 128 and exterior surface 126 of outer body 120. The inner body 140 has an exterior surface 146 and an interior surface 148. The surfaces 146, 148 of inner body 140 extend between a first end 142 toward a second end 143. The exterior surface 146 of the inner body 140 includes a second plurality of openings 150. Inner body 140 preferably has a base 141 at the first end 142 and an apex 144 at the second end 143. The base 141 preferably has a larger cross section than the apex 144. A mixing channel 170 is defined between the exterior surface 146 of inner body 140 and the interior surface 128 of outer body 120.

As is illustrated in FIGS. 2 and 3, outer body 120 is preferably substantially cylindrical in shape, and inner body 140 is preferably substantially conical in shape and is preferably centered within the outer body 120. Additionally, the inlet end 122 of outer body 120 is preferably axially aligned with the first end 142 of inner body 140. The first plurality of openings 130 included on the interior surface 128 of outer body 120 are preferably substantially radially oriented so that an oxidizing agent such as air flowing therethrough is injected substantially radially inward. Similarly, the second plurality of openings 150 included on the exterior surface 146 of inner body 140 are preferably substantially radially oriented so that an oxidizing agent such as air flowing therethrough is injected substantially radially outward. In this form of the present invention both the first plurality of openings 130 and the second plurality of openings 150 are both helical slots.

As illustrated in this form of the invention, premixer 100 has an annular surface 160 connecting the first end 142 of inner body 140 to the inlet end 122 of outer body 120. The annular surface 160 includes a plurality of fuel orifices 162 permitting fuel to be introduced into the mixing channel 170. The premixer 100 may also include a plurality of orifices 132 defined between the exterior surface 126 and interior surface 128 of outer body 120 for the introduction of an oxidizing agent such as air near the head end 122 with the introduction of fuel. The orifices 132 preferably inject air into the center of each discrete vortex at or near the head end 122 of the premixer 100.

Figure 4:
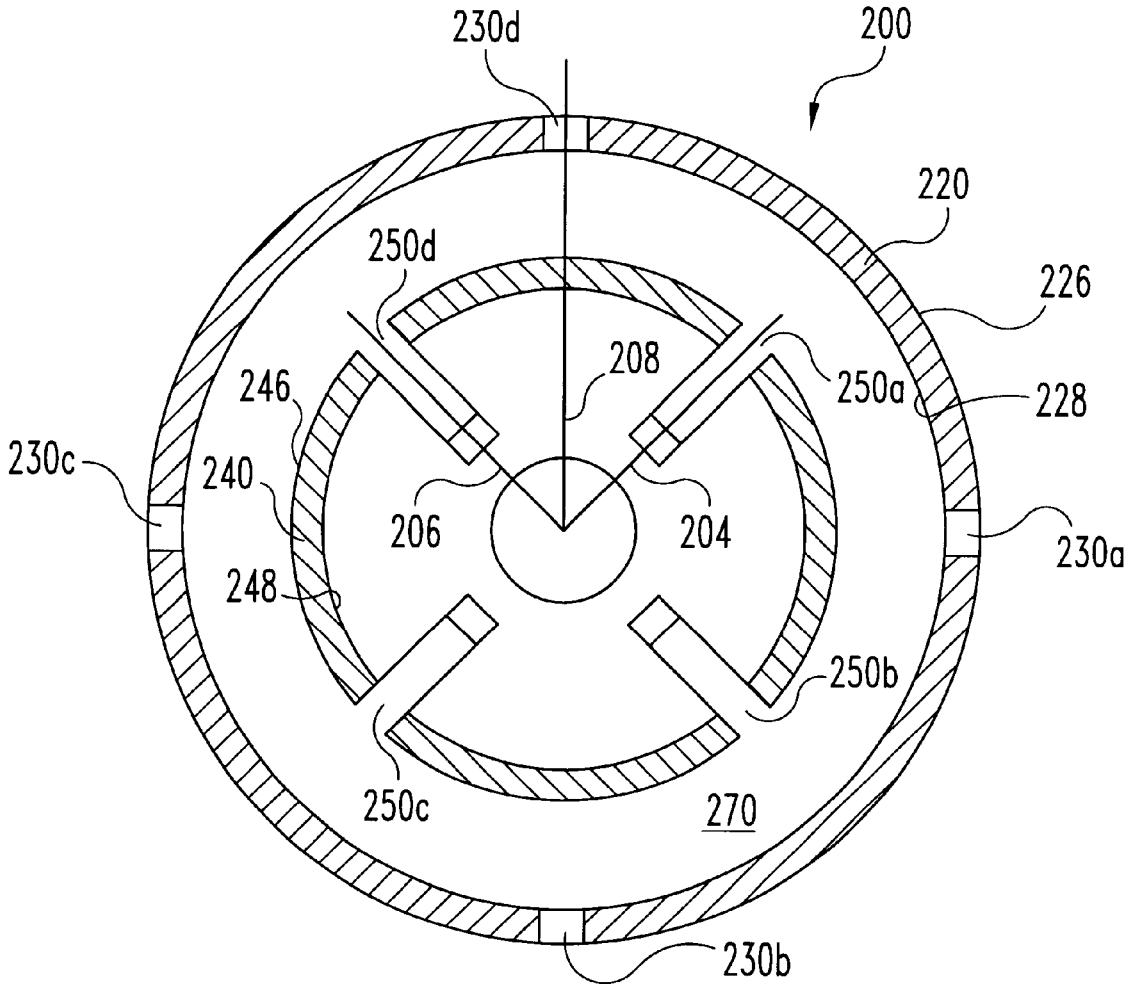
FIG. 4 is an end cross-sectional view of another form of the premixer of the present invention.

With reference to FIG. 4 there is illustrated another form of the present invention. The premixer 200 includes a first or outer body 220 and a second or inner body 240. The outer body 220 has an outer or exterior surface 226 and an inner or interior surface 228. The surfaces 226, 228 of outer body 220 extend between a head or inlet end (not illustrated) and an exhaust or outlet end (not illustrated). The outer body 220 is substantially hollow and the interior surface 228 of outer body 220 includes a first plurality of openings 230 including four openings 230*a*, 230*b*, 230*c*, 230*d* for injecting air inward. The inner body 240 has an exterior surface 246 and an interior surface 248. The surfaces 246, 248 of inner body 240 extend between a first end (not illustrated) toward a second end (not illustrated). The exterior surface 246 of the inner body 240 includes a second plurality of openings 250 including four openings 250*a*, 250*b*, 250*c*, 250*d* for injecting air outward. Inner body 240 preferably decreases in cross section from the first end 242 to the second end 243. A mixing channel 270 is defined between the exterior surface 246 of inner body 240 and the interior surface 228 of outer body 220.

As illustrated in FIG. 4, the first plurality of openings 230 are preferably radially offset from the second plurality of openings. This is best understood with reference to line 204 extending radially outward from the axis through opening 250*a*, and line 206 extending radially outward from the axis through opening 250*d*. The line 208 extending radially outward from the axis through the opening 230*d* formed on the outer body 220 is radially offset from the lines 204, 206 through openings 250*a*, 250*d* on inner body 240. In the more preferred form, as illustrated in FIG. 4, the openings 230 on the outer body 220 bisect the angle between adjacent openings 250 on the inner body 240, and vice-versa.

Figure 5:
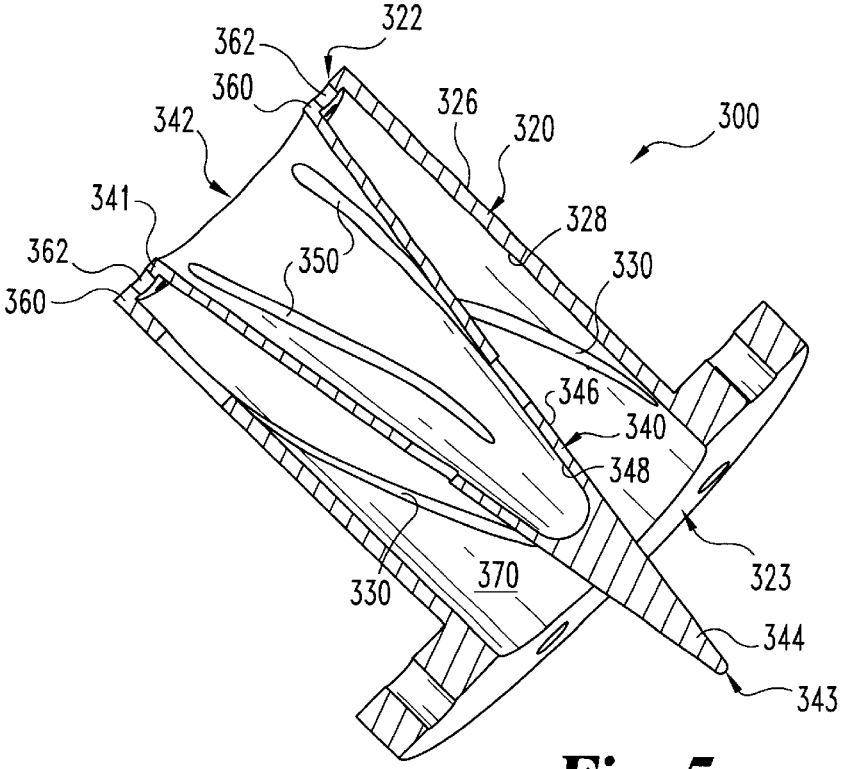
FIG. 5 is a perspective cross-sectional view of another form of the premixer of the present invention having openings that are helical slots.

With reference to FIG. 5 there is illustrated another form of the present invention. The premixer 300 includes a first or outer body 320 and a second or inner body 340. The outer body 320 has an outer or exterior surface 326 and an inner or interior surface 328. The surfaces 326, 328 of outer body 320 extend between a head or inlet end 322 and an exhaust or outlet end 323. The outer body 320 is substantially hollow and the interior surface 328 of outer body 320 includes a first plurality of openings 330. The inner body 340 has an exterior surface 346 and an interior surface 348. The surfaces 346, 348 of inner body 340 extend between a first end 342 toward a second end 343. The exterior surface 346 of the inner body 340 includes a second plurality of openings 350. Inner body 340 preferably has a base 341 at the first end 342 and an apex 344 at the second end 343. The base 341 preferably has a larger cross section than the apex 344. A mixing channel 370 is defined between the exterior surface 346 of inner body 340 and the interior surface 328 of outer body 320. The first plurality of openings 330 preferably extend along substantially the entire length between the head end 322 and the exhaust end 323 of the outer body 320. Similarly, the second plurality of openings preferably extend along substantially the entire length between the first end 342 and the exhaust end 343 of the inner body 340. In other words, the first plurality of openings 330 and the second plurality of openings 350 substantially longitudinally span the outer body 320 and the inner body 340, respectively. It should be understood that where one body is shorter than the other, the words stating that the openings substantially longitudinally span at least one of the bodies shall be defined as meaning that both pluralities of openings extend at least along substantially the entire length of the shorter of the two bodies.

Figure 6:
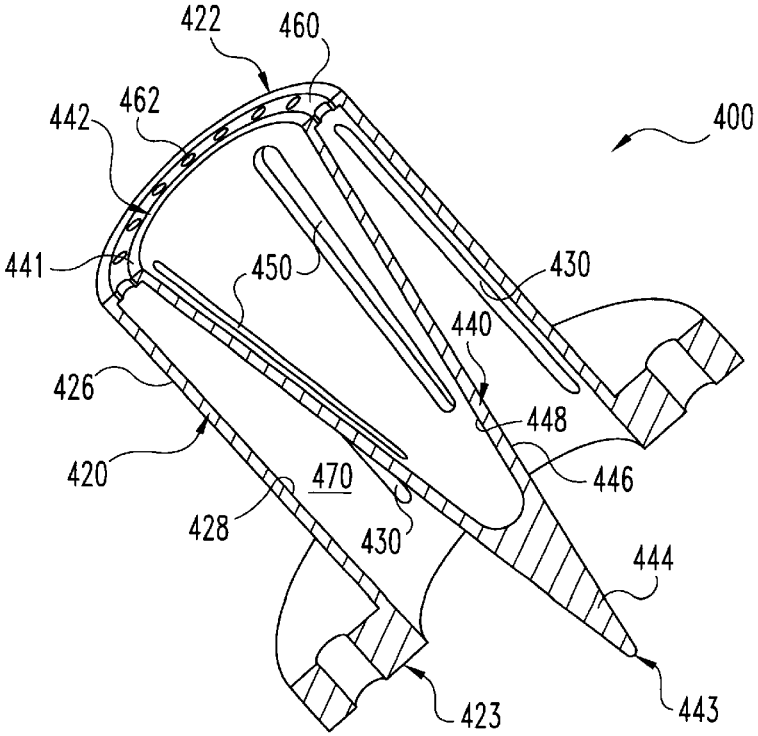
FIG. 6 is a perspective cross-sectional view of another form of the premixer of the present invention having openings that are straight slots.

With reference to FIG. 6, there is illustrated another form of the present invention. The premixer 400 is a modified version of the premixer 300 of FIG. 5. As with premixer 300, the premixer 400 includes a first or outer body 420 and a second or inner body 440. The outer body 420 has an outer or exterior surface 426 and an inner or interior surface 428. The surfaces 426, 428 of outer body 420 extend between a head or inlet end 422 and an exhaust or outlet end 423. The outer body 420 is substantially hollow and the interior surface 428 of outer body 420 includes a first plurality of openings 430. The inner body 440 has an exterior surface 446 and an interior surface 448. The surfaces 446, 448 of inner body 440 extend between a first end 442 toward a second end 443. The exterior surface 446 of the inner body 440 includes a second plurality of openings 450. Inner body 440 preferably has a base 441 at the first end 442 and an apex 444 at the second end 443. The base 441 preferably has a larger cross section than the apex 444. A mixing channel 470 is defined between the exterior surface 446 of inner body 440 and the interior surface 428 of outer body 420. The primary difference between the premixer 400 and the premixer 300 is that the first plurality of openings 430 and second plurality of openings 450 of premixer 400 are longitudinally extending (i.e. straight) slots instead of the helical slots 330, 350 of premixer 300. As with premixer 300, the first plurality of openings 430 and second plurality of openings 450 substantially longitudinally span the length of the outer body 420 and inner body 440, respectively.

Figure 7:
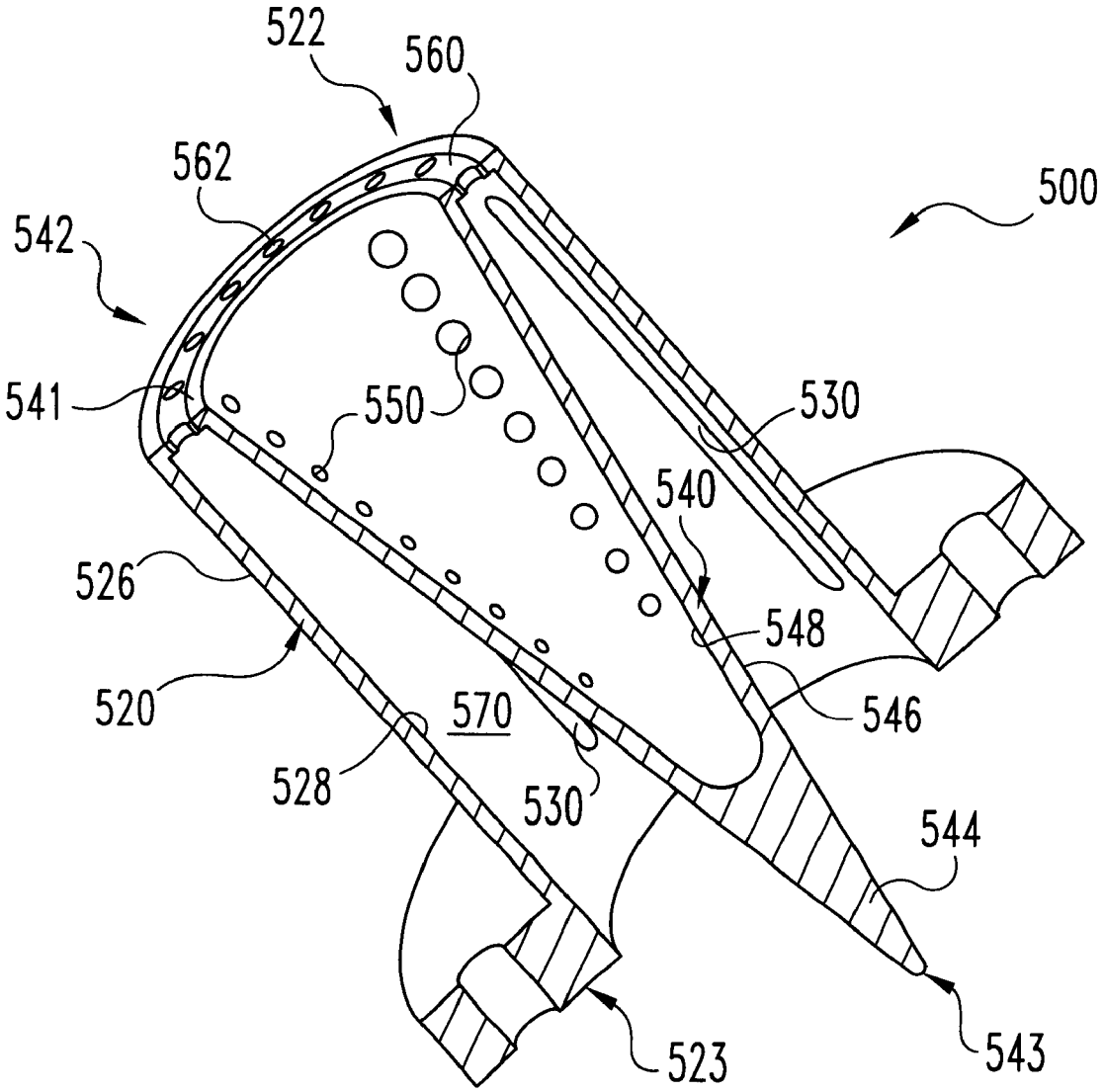
FIG. 7 is a perspective cross-sectional view of another form of the premixer of the present invention including openings that are a plurality of discrete orifices.

With reference to FIG. 7 there is illustrated another form of the present invention. The premixer 500 is a modified version of the premixer 400 of FIG. 6. As with premixer 400, the premixer 500 includes a first or outer body 520 and a second or inner body 540. The outer body 520 has an outer or exterior surface 526 and an inner or interior surface 528. The surfaces 526, 528 of outer body 520 extend between a head or inlet end 522 toward an exhaust or outlet end 523. The outer body 520 is substantially hollow and the interior surface 528 of outer body 520 includes a first plurality of openings 530. The inner body 540 has an exterior surface 546 and an interior surface 548. The surfaces 546, 548 of inner body 540 extend between a first end 542 toward a second end 543. The exterior surface 546 of the inner body 540 includes a second plurality of openings 550. Inner body 540 preferably has a base 541 at the first end 542 and an apex 544 at the second end 543. The base 541 preferably has a larger cross section than the apex 544. A mixing channel 570 is defined between the exterior surface 546 of inner body 540 and the interior surface 528 of outer body 520. The primary difference between the premixer 500 and the premixer 400 is that each of the second plurality of openings 550 are a plurality of longitudinally extending discrete orifices instead of the longitudinally extending slots 450 of premixer 400. As with premixer 400, the first plurality of openings 530 and second plurality of openings 550 substantially longitudinally span the length of the outer body 520 and inner body 540, respectively.

Figure 8:
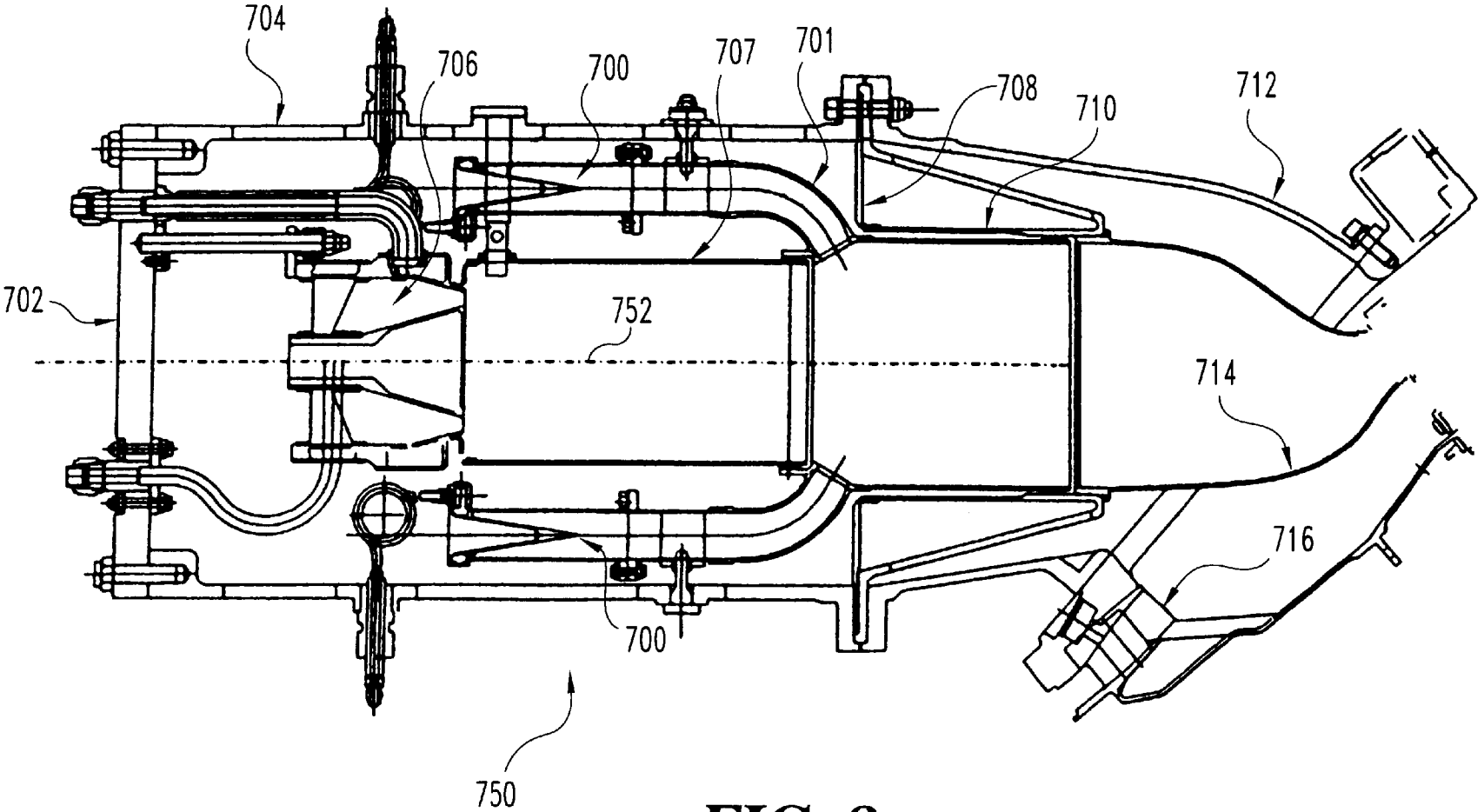
FIG. 8 is a side cross sectional illustration of the implementation of the premixer of the present invention in a design for an advanced turbine system.

With reference to FIG. 8 there is illustrated the use of a premixer 700 of the present invention in one form of an advanced turbine system configuration 750. The configuration 750 includes a silo cover 702 located at the beginning of the axis 752 of the combustor case 704. Within the combustor case 704 is a primary premixer 706 and a plurality of secondary premixers 700, the latter illustrated as including some or all of the improvements of the present invention. The primary premixer 706 is connected to the combustor within the primary combustion liner 707. Each of the secondary premixers 700, of which there are preferably ten, exhausts into a secondary premix tube that itself exhausts into a second combustion area near colander plate 708. The secondary premixers 700 are preferably spaced circumferentially about the exterior of the primary combustion liner 707. The second combustion area is defined by a secondary combustion liner 710. The advanced turbine system configuration 750 also includes a transition case 712 with a transition liner 714, and a diffuser case 716.

The above descriptions with respect to various forms of the invention each focus on a particular feature. It should be understood, however, that the most preferred form of the invention is a premixer having a cylindrical outer body and a conical inner body centered within the outer body, the premixer including: substantially radially oriented helical slots on the outer body and the inner body that are radially offset from one another and that substantially longitudinally span at least one of the bodies. It should be further understood that myriad variations, that may or may not include any single or combination of the just described features as desired, are contemplated as within the scope of the invention. Some of these variations are discussed below.

One form of the premixer of the present invention was illustrated (see FIG. 4) with four openings 250*a*, 250*b*, 250*c*, 250*d* on the inner body 240 and four openings 230*a*, 230*b*, 230*c*, 230*d* on the outer body 220. It should be understood, however, that any number of openings from two upward is contemplated as within the scope of the invention. The most preferred form of the invention uses offset substantially radial air injection through helical slots to create multiple vortices, which produces a highly mixed fluid. The use of air injection openings other than helical slots is contemplated as within the scope of the invention; including, but not limited to, straight slots 430, 450 (see FIG. 6), helical or longitudinally extending discrete orifices 550 (see FIG. 7), or some combination of any of these (see FIG. 7). Additionally, while the openings preferably substantially longitudinally span the length of at least one of the bodies, the openings need not be continuous. For example, each opening may be a plurality of slots or groups of discrete orifices at axially spaced intervals, or some combination of both. While the slots or discrete orifices are preferably the same size, different sizes of either or both on a single premixer are contemplated as within the scope of the invention. While the orifices are preferably circular, as illustrated in FIG. 7, other shapes known to those of ordinary skill in the art are contemplated as within the scope of the invention. It should be understood that the openings may span only various portions or even a single portion of the length of one or both bodies. The openings are, of course, preferably offset in order to produce vortices and the air is preferably injected gradually along the axial length of the premixer.

It should also be understood that the inner body, while always illustrated as conical, may be any of a variety of shapes known to those of skill in the art. Any shape that produces a high axial velocity and limits the cross-sectional area near the fuel injection is preferable for the inner body. This will generally include an inner body having a base with a larger cross-sectional area than the apex. The interior of the inner body may be hollow with the openings included between the interior surface and the exterior surface connecting to a single passage connected to a supply of air. Alternatively, the exterior surface of the inner body may include openings connected to one or more passages that are in turn connected to each other and/or a supply of air. Similarly, the interior surface of the outer body may include openings connected to one or more passages that are in turn connected to each other and/or a supply of air, or the openings on the outer body may extend between the interior surface and the exterior surface of the outer body.

It should be understood that the inner body preferably, but not necessarily, provides a variety of functions including, but not limited to, more efficient mixing and reduction or prevention of flashback and autoignition. The fuel is preferably axially injected at the base where there is the minimum amount of cross-sectional area. This increases the likelihood that fuel will be dispersed over the full area and thereby produces more consistent mixing. A conical inner body creates an annulus with increasing cross-sectional area. The rate of increasing cross-sectional area, however, need not be constant. However, air is preferably being added to the mixing channel at a constant rate, while the rate of increasing annular area is reducing resulting in an increase in axial velocity. Thus, the premixer preferably has a high initial axial gas velocity that increases along the length of the premixer, thus reducing or preventing flashback and autoignition. Alternatively, the change in the annular area of the mixing channel may be accomplished with a cylindrical inner body and an outer body of increasing cross-section, for example a frusto-conical outer body with a smaller cross-section at the inlet end and a larger cross-section at the outlet end.

Having generally described the features of various forms of the present invention, the method of use of the most preferred form will be generically described with reference to FIGS. 4 and 5. The method described for these forms of the present invention being equally applicable to any combination of the previously described forms. Referring to FIG. 5, in the most preferred form of the invention the fuel is injected through a number of orifices 362, at the upstream most face 360 of the premixer 300 through, for example, a fuel manifold. An oxidizing agent is then gradually added along the length of the premixer 300 through offset helical slots 330, 350 (that are preferably substantially radially oriented) injecting air into an annular mixing region 370. Referring to FIG. 4, in the most preferred form of the present invention the slots 250 of the inner body 240 are clocked such that at any axial location the air injection vector 208 of the outer body 220 bisects the air injection vectors 204, 206 of the slots 250*a*, 250*d* of the inner body 240 and vice versa. This series of offset substantially radially oriented helical air injection slots creates a number of vortices. Each vortex rotates in the opposite direction as the neighboring vortex creating a coherent series of coupled vortices along the length of the annulus. It should be understood, however, that at the apex of the conical inner body the vortices coalesce and create a violent mixing region.

The number of fuel injection points 362 may be kept to a minimum as may be especially advantageous in smaller premixers. This is due to the fact that the initial injection plane coincident with the head end 322 of the outer body 320 and the first end 342 of the inner body 340 is an annulus with minimal thickness; thus there is not a large area to spread the fuel. In addition, each vortex shares two sides with other vortices, thus allowing fuel to disperse from one vortex to the next. The form of the present invention illustrated in FIG. 4 creates eight vortices, but only needs four points of fuel injection. The fuel dispersal in the present invention preferably relies on the vortex motion created in the mixing annulus 270, rather than relying on momentum to carry the fuel to the desired location. Thus, the mixedness remains nearly constant over a wide range of fuel-to-air ratios. Additionally, by virtue of the fuel entering at the head end 322 only and the air entering over the length of the premixer 300, any pressure oscillation in the flow will be muffled reducing temporal variation in the mixing. This ability to passively damp out combustor noise feedback is believed to be particularly beneficial in light of the current state of the art.

Some or all of the above forms of the present invention may be used to create a highly mixed fuel-air mixture with negligible bulk swirl over a wide range of fuel-to-air ratios within a very short residence time. The use of swirl to create a turbulent environment for efficient mixing is common. Often, this swirl is used to create a collapsing vortex with reverse flow for flame anchoring. However, swirl is not always required or desired. The above forms of the invention preferably use the combination of numerous vortices with opposing swirl to create a flow that has negligible bulk swirl. Many premixers vary in their ability dependent on the fuel momentum. In such premixers mixedness will vary as the fuel/air ratio is increased. The mixedness provided by various forms of the present invention is preferably, but not necessarily, less dependent on fuel flow. Many fuel-air mixers require a long mixing chamber to allow time for the constituents to properly combine. The intense turbulence created by some forms of the present invention preferably, but not necessarily, achieves fuel-air mixing within a very short distance and thus requires very little residence time or physical space.

The premixer of the present invention is a lean premix module design that preferably provides an extremely uniform mixture of reactants such as fuel and air, enabling significant reductions in oxides of nitrogen ($NO_x$) while maintaining low levels of carbon monoxide (CO) and unburned hydrocarbons (UHC). The premixer of the present invention may be used to feed a uniform fuel air mixture over a very wide range of fuel air ratios to the second of two stages in a series-staged combustor. It should be understood that the present invention may also be applied to fueling the primary (or subsequent stages) of a series staged combustor, or to other combustors known to those of ordinary skill in the art including, but not limited to, combustors that employ other turndown techniques, such as parallel staging, variable geometry, overboard bleed, etc. It should also be understood that while the premixer of the present invention is intended for use with gaseous fuel, the use of liquid fuels is also contemplated as within the scope of the invention. It should be further understood that the first oxidizing agent injected through the outer body and the second oxidizing agent injected through the inner body are preferably the same and are more preferably compressor discharge air.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In reading the claims it is intended that when words such as "a", "an", "at least one", "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An apparatus for mixing fuel with oxidizing agent, comprising:

a substantially hollow first member having an inner surface and an outer surface, the surfaces extending between an inlet end and an outlet end of the first member, the inner surface including a first plurality of substantially radially oriented openings connected to a first passageway receiving a first oxidizing agent;

a second member having a first end and a second end and an exterior surface extending therebetween including a second plurality of substantially radially oriented openings connected to a second passageway receiving a second oxidizing agent; and, wherein at least a portion of the exterior surface of the second member is positioned within the first member so that the inner surface of the first member and the exterior surface of the second member define a mixing channel.

2. The apparatus of claim 1, wherein the first plurality of openings substantially longitudinally span the inner surface of the first member between the inlet end and the outlet end.

3. The apparatus of claim 2, wherein each of the first plurality of openings is a plurality of discrete orifices.

4. The apparatus of claim 1, wherein the second plurality of openings substantially longitudinally span the exterior surface of the second member between the first end and the second end.

5. The apparatus of claim 1, wherein the first plurality of opening is radially offset from the second plurality of openings.

6. The apparatus of claim 5, wherein the first plurality of openings substantially longitudinally span the inner surface of the first member between the inlet end and the outlet end and the second plurality of openings substantially longitudinally span the exterior surface of the second member between the first end and the second end.

7. The apparatus of claim 1, wherein the first end of the second member is closer to the inlet end of the first member than the second end of the second member, the second member having a base at the first end and an apex at the second end, the base having a larger cross-section than the apex.

8. The apparatus of claim 7, wherein the first plurality of openings are radially offset from the second plurality of openings.

9. The apparatus of claim 8, wherein the first plurality of openings is a first plurality of slots and the second plurality of openings is a second plurality of slots.

10. The apparatus of claim 9, wherein the first plurality of slots and the second plurality of slots are helical.

11. The apparatus of claim 1, wherein the first member is substantially cylindrical and the second member is substantially conical.

12. The apparatus of claim 11, wherein the inlet end of the first member is substantially axially aligned with the first end of the second member.

13. The apparatus of claim 12, wherein the first and second plurality of openings substantially longitudinally span at least one of the first member, and the second member.

14. An apparatus for mixing fuel with oxidizing agent, comprising:

an outer body having an interior surface extending between an inlet end and an outlet end, the interior surface including a first plurality of openings;

an inner body having an exterior surface extending between a first end and a second end, the exterior surface of the inner body including a second plurality of opening; and, wherein at least a portion of the exterior surface of the inner body is positioned within the outer body to define a mixing channel between the exterior surface of the inner body and the interior surface of the outer body, and the first and second plurality of openings substantially longitudinally span at least one of the inner body and the outer body.

15. The apparatus of claim 14, wherein the first and second plurality of openings are substantially radially oriented.

16. The apparatus of claim 15, wherein at least one opening of either the first or second plurality of openings is a slot.

17. The apparatus of claim 16, wherein the first plurality of openings are radially offset from the second plurality of openings.

18. The apparatus of claim 15, wherein at least one opening of either the first or second plurality of openings is a plurality of discrete orifices.

19. The apparatus of claim 14, wherein the inner body has a base at the first end and an apex at the second end, the base having a larger cross-section than the apex.

20. The apparatus of claim 14, wherein the first plurality of openings are radially offset from the second plurality of openings.

21. The apparatus of claim 20, wherein the first plurality of openings is a first plurality of slots and the second plurality of openings is a second plurality of slots, and wherein the first and second plurality of openings are substantially radially oriented.

22. The apparatus of claim 21, wherein the first plurality of slots and the second plurality of slots are helical.

23. The apparatus of claim 21, wherein the outer body is substantially cylindrical and the inner body is substantially conical and wherein the first plurality of slots and the second plurality of slots are straight.

24. An apparatus for mixing fuel with oxidizing agent, comprising:

a substantially hollow first body having an inner surface including a first plurality of openings spaced around a perimeter of the inner surface at an axial location of the inner surface; and, a second body at least partially positioned within the first body, the second body having an outer surface including a second plurality of openings, the second plurality of openings being spaced around a perimeter of the outer surface, the second plurality of openings being offset from the first plurality of openings at the axial location.

25. The apparatus of claim 24, wherein the first plurality of openings and the second plurality of openings are substantially radially oriented.

26. The apparatus of claim 25, wherein at least one opening of either the first or second plurality of openings is a slot.

27. The apparatus of claim 26, wherein the slot is helical.

28. The apparatus of claim 25, wherein the first body is substantially cylindrical and the second body is substantially conical.

29. The apparatus of claim 28, wherein an inlet end of the first body is substantially axially aligned with a first end of the second body.

30. The apparatus of claim 29, wherein the first and second plurality of openings substantially longitudinally span at least one of the first body and the second body.

31. The apparatus of claim 25, wherein at least one opening of either the first or second plurality of openings is a plurality of substantially radially oriented discrete orifices.

* * * * *